US010012418B1

(12) United States Patent
Storch

(10) Patent No.: US 10,012,418 B1
(45) Date of Patent: Jul. 3, 2018

(54) ELIMINATING COMPRESSOR-GENERATED NOISE WITHIN A PREDETERMINED INTERVAL DURING OPERATION OF A REFRIGERATION SYSTEM

(71) Applicant: Felix Storch, Inc., Bronx, NY (US)

(72) Inventor: Paul Storch, Bronx, NY (US)

( * ) Notice: Subject to any disclaimer, the term of this patent is extended or adjusted under 35 U.S.C. 154(b) by 632 days.

(21) Appl. No.: 14/509,203

(22) Filed: Oct. 8, 2014

(51) Int. Cl.

| | |
|---|---|
| ***F25B 25/00*** | (2006.01) |
| ***F25B 21/02*** | (2006.01) |
| ***F25D 19/04*** | (2006.01) |
| ***F25D 29/00*** | (2006.01) |

(52) U.S. Cl.
CPC ..... *F25B 25/005* (2013.01); *F25B 21/02* (2013.01); *F25D 19/04* (2013.01); *F25D 29/00* (2013.01); *F25D 2600/02* (2013.01)

(58) Field of Classification Search
CPC ..... F25D 19/04; F25D 29/00; F25D 2600/02; F25B 25/005; F25B 21/02
USPC ..... 62/3.6, 3.61, 3.62, 3.63, 3.64, 3.7
See application file for complete search history.

(56) References Cited

U.S. PATENT DOCUMENTS

| | | | | |
|---|---|---|---|---|
| 3,237,415 | A * | 3/1966 | Newton | F25B 21/02 62/185 |
| 3,643,459 | A | 2/1972 | Matthies | |
| 5,402,644 | A * | 4/1995 | Faries, Jr. | A61F 7/0241 62/135 |
| 5,682,756 | A | 11/1997 | Lehmiller et al. | |
| 5,711,159 | A * | 1/1998 | Whipple, III | F25D 17/065 62/186 |
| 8,528,352 | B2 | 9/2013 | Kawamukai et al. | |
| 2006/0144073 | A1* | 7/2006 | Lee | F25B 21/02 62/333 |
| 2007/0193280 | A1* | 8/2007 | Tuskiewicz | A47F 3/0404 62/3.6 |
| 2010/0152904 | A1* | 6/2010 | Kawaguchi | F25B 49/022 700/275 |

(Continued)

FOREIGN PATENT DOCUMENTS

| | | | |
|---|---|---|---|
| CN | 202938586 | U | 5/2013 |
| WO | 2007032608 | A1 | 3/2007 |
| WO | 2010123239 | A2 | 10/2010 |

*Primary Examiner* — Ljiljana Ciric
*Assistant Examiner* — Kirstin Oswald
(74) *Attorney, Agent, or Firm* — Arthur Jacob

(57) ABSTRACT

A refrigeration system and a method eliminate compressor-generated noise within a predetermined interval during operation of the refrigerator system wherein an interior of a refrigerator normally is maintained within a desired cool temperature range by operation of a compressor-driven refrigeration device. A thermo-electric refrigeration device is placed in communication with the interior of the refrigerator for cooling the interior of the refrigerator. A control system is coupled with the compressor-driven refrigeration device and with the thermo-electric refrigeration device, and is configured to discontinue operation of the compressor-driven refrigeration device for the duration of the predetermined interval, and to activate the thermo-electric refrigeration device during the predetermined interval so as to maintain the interior of the refrigerator within the desired cool temperature range, while compressor-generated noise associated with operation of the compressor-driven refrigeration device is discontinued.

14 Claims, 2 Drawing Sheets

(56) References Cited

U.S. PATENT DOCUMENTS

Figure 1:
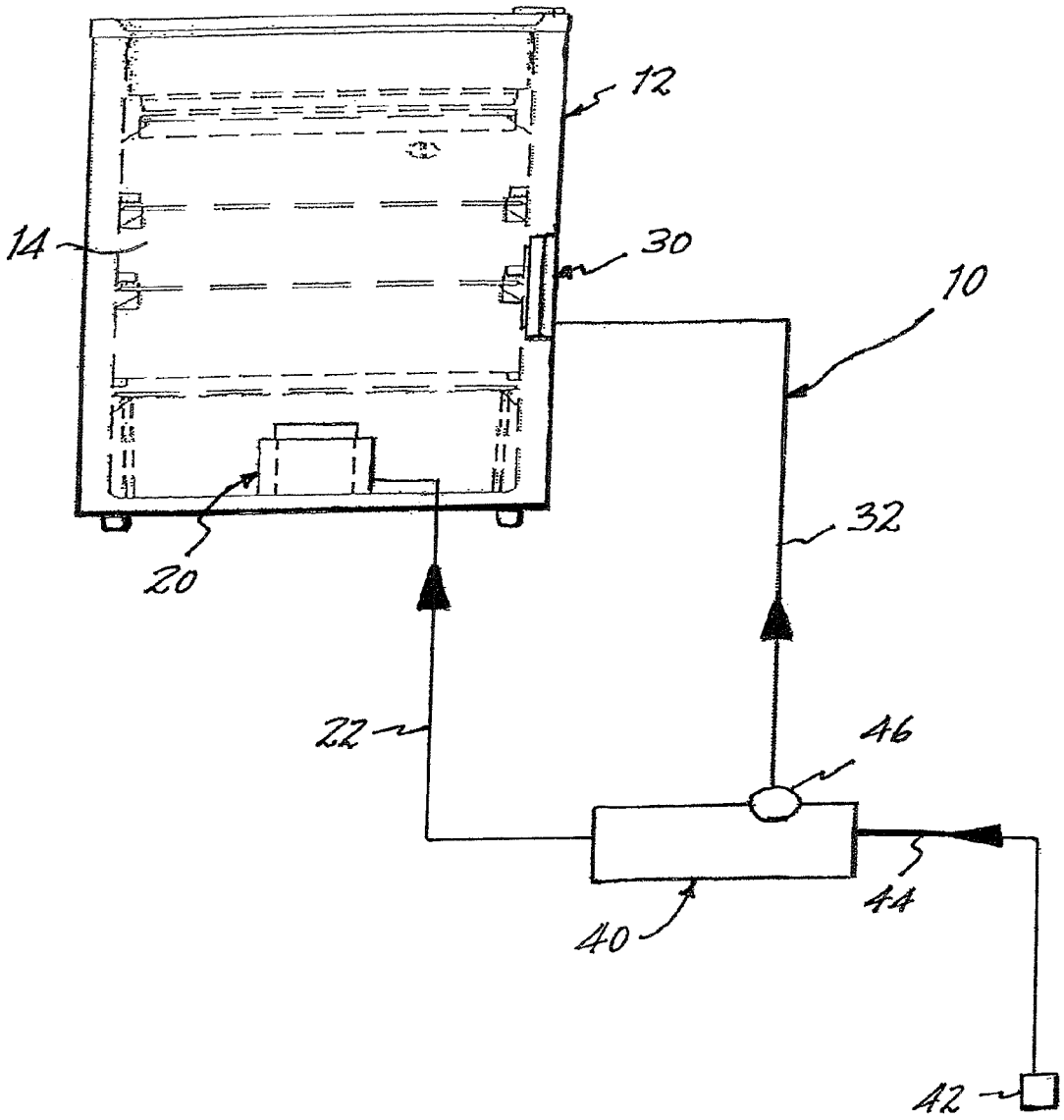

2014/0174100 A1 6/2014 Biotti et al.

* cited by examiner

ELIMINATING COMPRESSOR-GENERATED NOISE WITHIN A PREDETERMINED INTERVAL DURING OPERATION OF A REFRIGERATION SYSTEM

The present invention relates generally to the operation of refrigerators and pertains, more specifically, to apparatus and method for eliminating compressor-generated noise within a predetermined interval during operation of a refrigeration system in which the interior of a refrigerator normally is maintained within a desired cool temperature range by the operation of a compressor-driven refrigeration device.

Most modern hotels offer guests the convenience of a refrigerator, or minibar, located directly within the rooms occupied by the guests. While such an amenity is welcomed by guests, many guests have complained about noise generated by the compressor-driven refrigeration units found in the greatest number of these refrigerators, particularly during nighttime, when such compressor-generated noise can disturb a guest's sleep. The problem of compressor-generated noise is exacerbated in "suite" hotels where studio rooms often are provided with full-size refrigerators. Further, new energy conservation regulations are forcing the adoption of higher speed compressors which create even greater, and more irritating, noise.

One solution to the problem of such compressor-generated noise is to furnish refrigerators and minibars that use absorption technology, rather than compressor-driven refrigeration devices, within a refrigeration system. However, absorption technology is less efficient and has been found to waste energy, as compared to the amount of energy used by a compressor-driven refrigeration unit. Moreover, absorption technology is based upon the use of ammonia as a refrigerant. The toxicity of ammonia has resulted in the reluctance of hotels to install absorption technology-based units in hotel rooms. Further, the likelihood of enactment of government regulations restricting or banning the use of ammonia-based absorption technology militates against continued adoption and use of refrigerators that employ such technology.

Another suggested solution is to incorporate timing devices into refrigerators that use a compressor-driven refrigeration device. The timing device can be programmed, as by a hotel guest, to turn off the refrigerator for a selected period of time, perhaps for eight hours during which the hotel guest wishes to sleep, and then to resume operation during the remaining sixteen hours of a day. While that solution enables the use of the more efficient compressor-driven refrigeration units, and may solve the problem of noise occurring during a selected period of time, the lack of providing cooling during the down-time can result in deterioration and spoilage of certain perishable items being stored in the refrigerator.

The present invention provides apparatus and method that avoid the pitfalls of the above-outlined solutions and attain several objects and advantages, some of which are summarized as follows: Eliminates compressor-generated noise within a predetermined interval during operation of a refrigeration system in which the interior of a refrigerator normally is maintained within a desired cool temperature range by operation of a compressor-driven refrigeration device, while still maintaining the desired cool temperature range; enables the use of an efficient compressor-driven refrigeration device in a refrigerator capable of maintaining a desired cool temperature range within the refrigerator during a predetermined interval when operation of the compressor is discontinued so as to eliminate compressor-generated noise; provides an effective, economical solution to the problem of compressor-generated noise occurring when not desired; allows a simple and economical retrofit for existing compressor-operated refrigerators to eliminate compressor-generated noise during a predetermined interval; enables a hotel guest to select a mode of operation during which a refrigerator in the guest's room can be silenced, without interrupting cooling of the contents of the refrigerator; provides a relatively simple apparatus and method capable of reliable operation over a long service life.

The above objects and advantages, as well as further objects and advantages, are attained by the present invention, which may be described briefly as a refrigeration system constructed for eliminating compressor-generated noise within a predetermined interval during operation of the refrigerator system wherein an interior of a refrigerator normally is maintained within a desired cool temperature range by operation of a compressor-driven refrigeration device, the refrigeration system comprising: a thermo-electric refrigeration device communicating with the interior of the refrigerator for cooling the interior of the refrigerator; and a control system coupled with the compressor-driven refrigeration device and with the thermo-electric refrigeration device, the control system being configured for providing a condition wherein operation of the compressor-driven refrigeration device is discontinued for the duration of the predetermined interval, and the thermo-electric refrigeration device is activated during the predetermined interval so as to maintain the interior of the refrigerator within the desired cool temperature range, while compressor-generated noise associated with the operation of the compressor-driven refrigeration device is discontinued.

In addition, the present invention provides a method for eliminating compressor-generated noise within a predetermined interval during operation of a refrigeration system wherein an interior of a refrigerator normally is maintained within a desired cool temperature range by operation of a compressor-driven refrigeration device, the method comprising: placing a thermo-electric refrigeration device in communication with the interior of the refrigerator for cooling the interior of the refrigerator; discontinuing operation of the compressor-driven refrigeration device for the duration of the predetermined interval; and activating the thermo-electric refrigeration device during the predetermined interval so that the interior of the refrigerator is maintained within the desired cool temperature range, while compressor-generated noise associated with the operation of the compressor-driven refrigeration device is discontinued.

Figure 2:
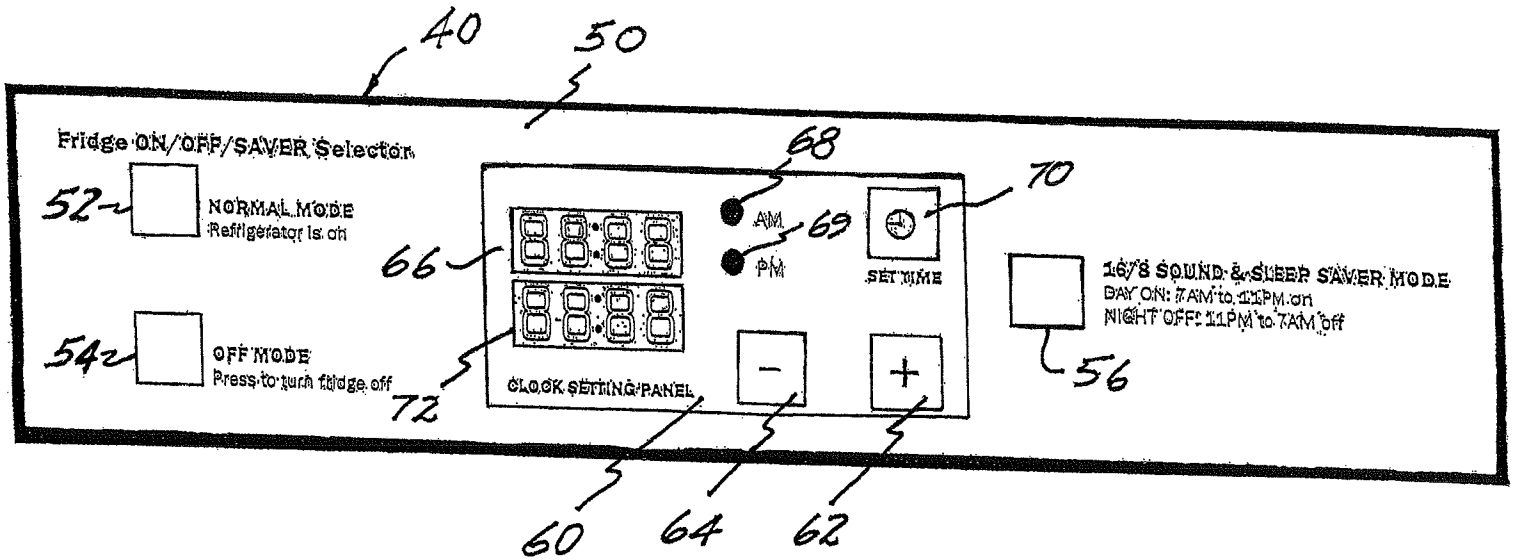

The present invention will be understood more fully, while still further objects and advantages will become apparent, in the following detailed description of preferred embodiments of the invention illustrated in the accompanying drawing, in which:

FIG. 1 is a largely diagrammatic depiction of a refrigeration system constructed and operated in accordance with the present invention; and FIG. 2 is a pictorial view of a component of the refrigeration system.

Referring now to the drawing, and especially to FIG. 1 thereof, a refrigeration system constructed and operated in accordance with the present invention is shown, largely diagrammatically, at 10 and is seen to include a refrigerator 12 having an interior 14 normally maintained within a desired cool temperature range, typically about 35° F. to about 48° F., by the operation of a compressor-driven refrigeration device illustrated in the form of refrigeration unit 20, in a now-conventional arrangement. Unit 20 is powered by line current, shown in the foam of an input line 22 connected to unit 20 for delivering alternating current (AC), typically available at 115 volts.

A thermo-electric refrigeration device is placed in communication with the interior 14 of refrigerator 12 and is shown in the form of thermo-electric refrigeration module 30. Module 30 is operated by direct current (DC) and is powered by an input line 32 connected to module 30 for delivering direct current at 12 volts.

A control system is shown in the than of control box 40 which receives line current, at 115 VAC, from a conventional electrical outlet 42, through a line cord 44. Through control box 40, input line 22 is supplied with alternating current at 115 VAC, and input line 32 is supplied with direct current at 12 VDC, by means of a 115 VAC/12 VDC converter 46, in accordance with a control protocol, as further described below.

With reference to FIG. 2, as well as to FIG. 1, control circuitry within control box 40 is configured to deliver operating current to input line 22 and to deliver current to line 32 in accordance with modes of operation selected at control panel 50 of control box 40. Thus, a user (not shown), such as a hotel guest, is provided with access to control panel 50 and may select one of three modes of operation. In a first mode of operation, selected by actuation of "NORMAL MODE" pushbutton 52, control circuitry within control box 40 is placed in a condition in which power is directed to refrigeration unit 20, through input line 22, and refrigeration unit 20 is operated continuously in a conventional manner to maintain the temperature inside interior 14 of refrigerator 12 within the desired cool temperature range, as regulated by a conventional temperature sensor-responsive component (not shown) of refrigeration unit 20. In this first mode of operation, no power is directed to thermo-electric refrigeration module 30, which remains dormant.

In a second mode of operation, selected by actuation of "OFF MODE" pushbutton 54, control circuitry within control box 40 is placed in a condition in which no power is directed to either the refrigeration unit 20 or the thermo-electric refrigeration module 30, and the entire refrigeration system 10 remains dot' cant. However, in this mode of operation, control box 40 remains powered.

In a third mode of operation, selected by actuation of "SOUND AND SLEEP SAVER MODE" pushbutton 56, control circuitry within control box 40 is placed in a condition in which power is directed to refrigerator unit 20, through input line 22, for operation of refrigeration unit 20 during a prescribed period, for example, during daytime, from 7:00 AM to 11:00 PM, so that interior 14 of refrigerator 12 is maintained within the desired cool temperature range, thereby retaining the contents of refrigerator 12 at a temperature most appropriate in serving the requirements of a guest occupying the room or suite in which the refrigerator 12 is located. Any compressor-generated noise emanating from the refrigerator 12 during that period either will be directed into an unoccupied room, or readily will be tolerated by a guest within the room. However, during nighttime, typically from 11:00 PM to 7:00 AM, when it becomes desirable to eliminate compressor-generated noise, power to refrigeration unit 20 is discontinued, and thermo-electric refrigeration module 30 is activated by furnishing power through input line 32. Activation of the thermo-electric refrigeration module 30 during such a predetermined interval will enable the thermo-electric refrigeration module 30 to operate, in response to a temperature sensor-responsive component (not shown) of the thermo-electric module 30, to maintain the temperature in interior 14 of refrigerator 12 within the desired cool temperature range, thereby avoiding spoilage of contents of the refrigerator 12, or any other deleterious consequences, that might occur as a result of temperatures rising above the desired cool temperature range within interior 14.

In the illustrated preferred embodiment, the predetermined interval, during which operation of compressor-driven refrigeration unit 20 is discontinued and thermo-electric refrigeration module 30 is activated, is fixed; that is, both the time and the duration of the predetermined interval cannot be altered by a guest. Thus, a guest is provided with the option of selecting only fixed modes of operation of the refrigerator 12, as described above. The time and duration provided by the third-described mode of operation remains as set by the circuitry within the control box 40, to which circuitry access is not available to the guest. However, other embodiments are feasible in which the time and duration or a predetermined interval can be adjusted to suit the requirements of a particular guest.

A clock setting panel 60 allows the time of day to be set into control box 40. A plus (+) pushbutton 62 and a minus (−) pushbutton 64 are actuated selectively, while the time setting is displayed at LED display 66, together with respective AM and PM indicators 68 and 69. Upon reaching the correct time, as indicated by the displays 66, 68 and 69, a "SET TIME" pushbutton 70 is actuated to set the correct time into control box 40. A second LED display 72 indicates the mode in which the control box 40 is set to operate.

The operating circuitry within control box 40 is well-known to persons skilled in the art of timing circuits and the like and need not be elaborated further herein. The various circuit conditions that provide the functions set forth above are created readily in an economical, reliable control arrangement.

The placement of a thermo-electric refrigeration module in communication with the interior of a refrigerator, together with an associated control system, such as described above in connection with the placement of thermo-electric refrigeration module 30 in communication with interior 14 of refrigerator 12, and the accompanying control box 40, is accomplished easily and economically, either in the original manufacture of a refrigerator, or as a retrofit for an existing refrigerator. In the former, control box 40 readily is integrated into refrigerator 12, while in the latter, control box 40 can be furnished in the form of a stand-alone component.

It will be seen that the present invention attains all of the objects and advantages outlined above, namely: Eliminates compressor-generated noise within a predetermined interval during operation of a refrigeration system in which the interior of a refrigerator normally is maintained within a desired cool temperature range by operation of a compressor-driven refrigeration device, while still maintaining the desired cool temperature range; enables the use of an efficient compressor-driven refrigeration device in a refrigerator capable of maintaining a desired cool temperature range within the refrigerator during a predetermined interval when operation of the compressor is discontinued so as to eliminate compressor-generated noise; provides an effective, economical solution to the problem of compressor-generated noise occurring when not desired; allows a simple and economical retrofit for existing compressor-operated refrigerators to eliminate compressor-generated noise during a predetermined interval; enables a hotel guest to select a mode of operation during which a refrigerator in the guest's room can be silenced, without interrupting cooling of the contents of the refrigerator; provides a relatively simple apparatus and method capable of reliable operation over a long service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A refrigeration system having a compressor-driven refrigeration device for maintaining a cooling temperature range within an interior of a refrigerator, the refrigeration system being constructed for eliminating compressor-generated noise for the duration of a controlled predetermined interval during operation of the refrigeration system, the refrigeration system comprising:

a thermo-electric refrigeration device communicating with the interior of the refrigerator for cooling the interior of the refrigerator upon activation of the thermo-electric device: and a control system coupled with the compressor-driven refrigeration device and with the thermo-electric refrigeration device, the control system being configured for establishing the duration of the controlled predetermined interval, and providing a condition wherein operation of the compressor-driven refrigeration device is discontinued for the duration of the predetermined interval, and the thermo-electric refrigeration device is activated during the predetermined interval so as to maintain the interior of the refrigerator within the cooling temperature range, for the duration of the predetermined interval, and operation of the compressor-driven refrigeration device is activated for maintaining the cooling temperature range within the interior of the refrigerator while outside the duration of the predetermined interval and is discontinued for the duration of the predetermined interval to eliminate, for the duration of the predetermined interval, compressor-generated noise associated with the operation of the compressor-driven refrigeration device.

2. The refrigeration system of claim 1 wherein the predetermined interval is fixed so as to be unavailable for alteration by a user of the refrigerator.

3. The refrigeration system of claim 1 wherein the control system is configured further to enable selection of a further condition in which the thermo-electric refrigeration device is deactivated and operation of the compressor-driven refrigeration device is continued for maintaining the cooling temperature range within the interior of the refrigerator.

4. The refrigeration system of claim 1 wherein the control system is configured further to enable selection of a further condition in which operation of the compressor-driven refrigeration device is discontinued and the thermo-electric refrigeration device is deactivated.

5. The refrigeration system of claim 1 wherein the control system is configured further to enable selection of a further condition in which the thermo-electric refrigeration device is deactivated and operation of the compressor-driven refrigeration device is continued for maintaining the cooling temperature range within the interior of the refrigerator, and to enable selection of a still further condition in which operation of the compressor-driven refrigeration device is discontinued and the thermo-electric refrigeration device is deactivated.

6. The refrigeration system of claim 1 wherein the control system includes a control panel located for ready access by a user of the refrigerator, the control panel providing control members selectively actuated to place the control system into one of:

a first condition in which operation of the compressor-driven refrigeration device is discontinued for the duration of the predetermined interval, and the thermo-electric refrigeration device is activated during the predetermined interval so as to maintain the interior of the refrigerator within the cooling temperature range, while compressor-generated noise associated with the operation of the compressor-driven refrigeration device is discontinued;

a second condition in which the thermo-electric refrigeration device is deactivated and operation of the compressor-driven refrigeration device is continued for maintaining the cooling temperature range within the interior of the refrigerator; and a third condition in which operation of the compressor-driven refrigeration device is discontinued and the thermo-electric refrigeration device is deactivated.

7. The refrigeration system of claim 6 wherein the predetermined interval is fixed so as to be unavailable for alteration by the user of the refrigerator.

8. A method for eliminating compressor-generated noise for the duration of a predetermined interval during operation of a refrigeration system wherein an interior of a refrigerator is maintained within a cooling temperature range by operation of a compressor-driven refrigeration device, the method comprising:

placing a thermo-electric refrigeration device in communication with the interior of the refrigerator for cooling the interior of the refrigerator upon activation of the thermo-electric device:

discontinuing operation of the compressor-driven refrigeration device for the duration of the predetermined interval; and activating the thermo-electric refrigeration device for the duration of the predetermined interval so that the interior of the refrigerator is maintained within the cooling temperature range, while operation of the compressor-driven refrigeration device is discontinued, and compressor-generated noise associated with the operation of the compressor-driven refrigeration device is eliminated during the predetermined interval.

9. The method of claim 8 including fixing the predetermined interval so as to be unavailable for alteration by a user of the refrigerator.

10. The method of claim 8 including providing a control system configured to enable selection of a condition in which the thermo-electric refrigeration device is deactivated and operation of the compressor-driven refrigeration device is continued for maintaining the cooling temperature range within the interior of the refrigerator.

11. The method of claim 8 including providing a control system configured to enable selection of a condition in which operation of the compressor-driven refrigeration device is discontinued and the thermo-electric refrigeration device is deactivated.

12. The method of claim 8 including providing a control system configured to enable selection of a condition in which the thermo-electric refrigeration device is deactivated and operation of the compressor-driven refrigeration device is continued for maintaining the cooling temperature range within the interior of the refrigerator, and to enable selection of a further condition in which operation of the compressor-driven refrigeration device is discontinued and the thermo-electric refrigeration device is deactivated.

13. The method of claim 8 including providing a control panel located for ready access by a user of the refrigerator, the control panel having control members selectively actuated to place the control system into one of:

a first condition in which operation of the compressor-driven refrigeration device is discontinued for the duration of the predetermined interval, and the thermo-electric refrigeration device is activated during the predetermined interval so as to maintain the interior of the refrigerator within the cooling temperature range, while compressor-generated noise associated with the operation of the compressor-driven refrigeration device is discontinued;

a second condition in which the thermo-electric refrigeration device is deactivated and operation of the compressor-driven refrigeration device is continued for maintaining the cooling temperature range within the interior of the refrigerator; and a third condition in which operation of the compressor-driven refrigeration device is discontinued and the thermo-electric refrigeration device is deactivated.

14. The method of claim 13 including fixing the predetermined interval so as to be unavailable for alteration by a user of the refrigerator.

* * * * *